US005085291A

United States Patent [19]

Narramore

[11] Patent Number: 5,085,291

[45] Date of Patent: Feb. 4, 1992

[54] SAFETY LADDER

[76] Inventor: Daniel O. Narramore, HCO 3 Box 74, Palo Verde, Ariz. 85343

[21] Appl. No.: 643,499

[22] Filed: Jan. 22, 1991

[51] Int. Cl.[5] ..... E06C 1/14

[52] U.S. Cl. ..... 182/106; 182/165; 182/210

[58] Field of Search ..... 182/106, 194, 210, 165, 182/176

[56] References Cited

U.S. PATENT DOCUMENTS

| | | | |
|---|---|---|---|
| 139,183 | 5/1873 | Post | 182/165 |
| 2,388,892 | 11/1945 | Wilson | 182/106 |
| 2,576,277 | 11/1951 | Biegen . | |
| 2,614,744 | 10/1952 | Hedglon . | |
| 2,640,641 | 6/1953 | Tepper . | |
| 3,834,491 | 9/1974 | Pelto | 182/106 |
| 4,044,857 | 8/1977 | Guerette . | |
| 4,293,055 | 10/1981 | Hooser . | |
| 4,723,631 | 2/1988 | Tremblay | 182/106 |

*Primary Examiner*—Reinaldo P. Machado
*Attorney, Agent, or Firm*—LaValle D. Ptak

[57] ABSTRACT

A safety ladder comprises a pair of spaced-apart parallel main support rails which typically extend between the ground and the side of a building. The steps of the ladder are connected between a second set of parallel side rails which are spaced inwardly toward the building, and are interconnected with the main side rails by means of truss-like support braces. This causes the step bearing portion of the ladder to be suspended from the load bearing rails to improve the stability of the ladder. The load bearing rails also act as hand rails, to assist users of the ladder in balancing on the ladder.

10 Claims, 3 Drawing Sheets

SAFETY LADDER

BACKGROUND OF THE INVENTION

Portable ladders typically are made in the form of a pair or parallel side rails, interconnected by a plurality of uniformly spaced steps or rungs Such ladders may include fixed length structures, adapted to be leaned against the side of a vertical surface, or may be constructed in the form of two or more sections, slidably interconnected to form an extension ladder. Another variation is in the form of a foldable step ladder, in which the step section is interconnected or hinged near the top, with a fold-out extension to form a substantially triangular support; so that the ladder can be used as a free-standing ladder.

In the use of a conventional ladder, whether it is a step ladder or is adapted to be placed at an angle against a surface, the user typically ascends and descends the ladder by grasping upper rungs or sides of the ladder with the hands while moving the feet from step-to-step on lower rungs or steps of the ladder. If such a ladder is placed against a surface at too steep an angle, it is not uncommon for the center of gravity to be such that the ladder is quite unstable, and capable of tipping over backwards under the weight of the person using the ladder. In addition, the rungs or steps of the ladder do not provide a convenient handrail or handgrip; and, at least for some persons, the lack of any surrounding side supports leads to a sense of insecurity.

Efforts to provide some type of safety handle for ladders have been devised. One such device is disclosed in the patent to Hooser U.S. Pat. No. 4,293,055. This patent discloses a conventional step ladder to which a retractable safety handle has been added. The handle is made to extend substantially vertically alongside the weight-bearing step portion of the ladder to a position located above the top of the ladder. The safety handle is made so that it can be folded into a compact position when the ladder is folded up for storage. The handle is not intended to carry any weight, and it doss not extend parallel to the rails to which the steps of the ladder are attached.

Other patents which are directed to ladders or portable stairways having handrails are Begin U.S. Pat. No. 2,576,277; Hedglon U.S. Pat. No. 2,614,744; Tepper U.S. Pat. No. 2,640,641; and Guerette U.S. Pat. No. 4,044,857. All of these patents disclose ladders or portable steps where a handrail is attached to the main weight-bearing portion of the ladder to facilitate use of the device. The steps or rungs of the ladders, however, are attached to the weight-bearing portion, and the handrails simply extend outwardly above the main weight-bearing step portion of the ladder. The steps or treads of the ladder are not suspended from the handrails.

It is desirable to provide a safety ladder which provides an improved center of gravity over the ladder constructions of the prior art, and which utilizes handrails as the weight-bearing portion of the ladder.

SUMMARY OF THE INVENTION

It is an object of this invention to provide an improved ladder construction.

It is another object of this invention to provide an improved safety ladder construction.

It is an additional object of this invention to provide an improved safety ladder construction utilizing handrails parallel to the step or rung-bearing portion of the ladder.

It is a further object of this invention to provide an improved safety ladder construction in which a pair of parallel handrails comprise the primary weight-bearing portion of the ladder, and the steps or rungs of the ladder are suspended from the handrails.

In accordance with a preferred embodiment of this invention, a pair of spaced-apart parallel side support rails comprise the main support members for the ladder. These support rails also function as handrails for the ladder. The rungs or steps of the ladder, however, are not connected between these parallel side rails, but instead are connected between a second set of parallel side rails which are spaced inwardly toward the building or wall (or toward the rear brace of a step ladder). This second set of side rails is the rung or step support portion of the ladder, and it is interconnected with the main weight-bearing side rails by means of suitable supports. This causes the rung or step-bearing portion of the ladder to be suspended from the load-bearing main support members forming the handrails of the ladder; so that the stability of the ladder is substantially improved.

BRIEF DESCRIPTION OF DRAWINGS

FIG. 5 is a perspective view of another embodiment of the invention;

DETAILED DESCRIPTION

Figure 1:
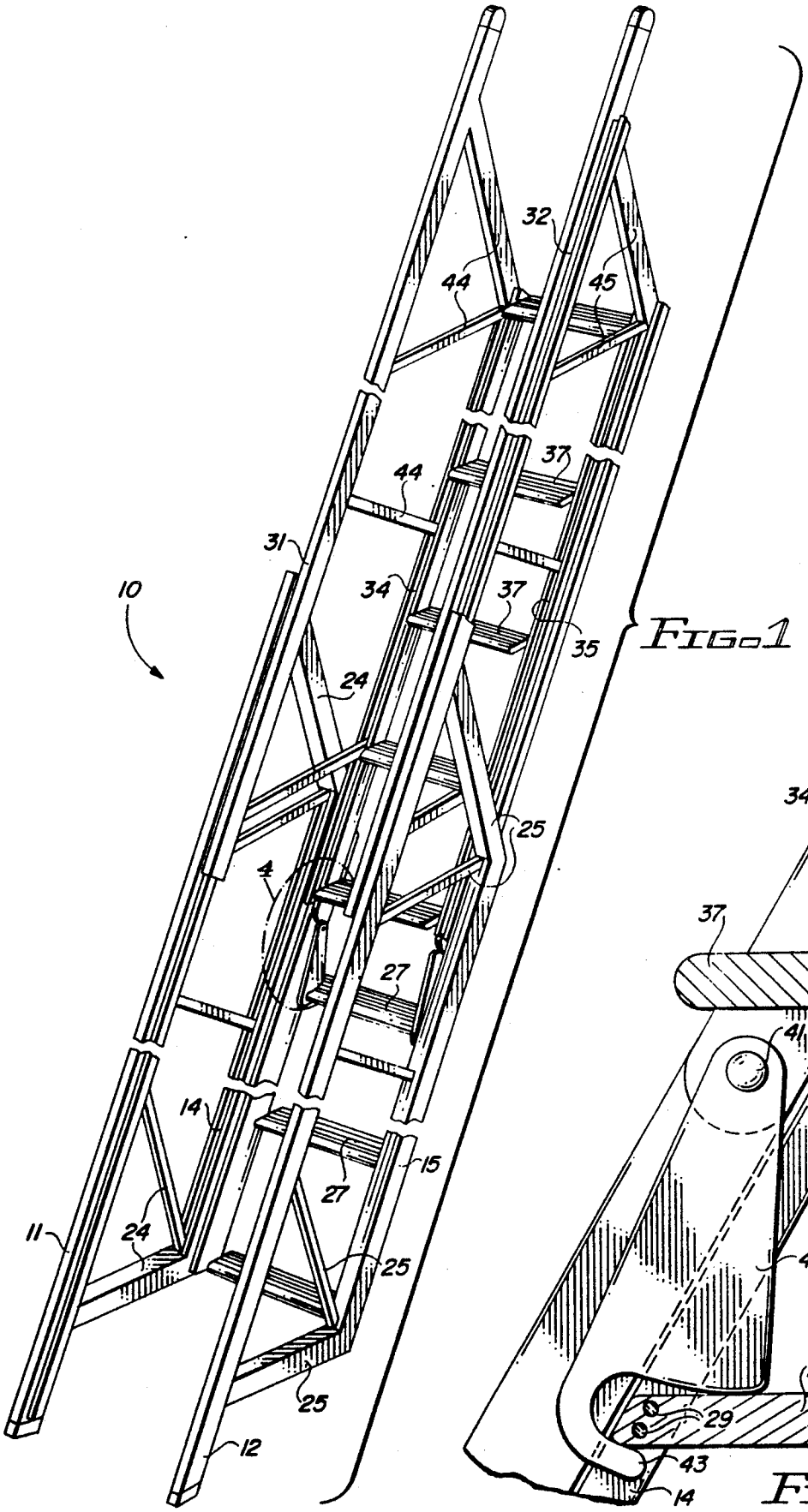
FIG. 1 is a longitudinal perspective view of a preferred embodiment of the invention.

Reference now should be made to the drawings in which the same reference numbers are used throughout the different figures to designate the same components. FIG. 1 shows a preferred embodiment of the invention, incorporated into an extension ladder configuration, for use in placement against the sides of buildings, walls and the like, in the manner of conventional ladders.

The ladder shown in FIG. 1 comprises a lower section with two spaced-apart main parallel support members or rails 11 and 12. The lower ends of each of the rails 11 and 12 are designed to rest on a generally horizontal lower surface, such as the ground or a floor. The upper ends of the main support members or rails 11 and 12 rest against a building surface, or accommodate a nesting pair of corresponding main support side rails 31 and 32 for an upper extension portion of the ladder, as shown in FIG. 1. Although the embodiment shown in FIG. 1 is illustrated as an extension ladder, the structure shown for either the lower section or the upper section of this ladder may be used alone.

A second pair of parallel step or rung supporting rails or side members 14 and 15 are spaced inwardly toward the building or wall, when the ladder is placed in use at an angle, as illustrated the main support rails 11 and 12 by means of truss-like side support brace members 24 and 25, to form a generally truss-like structure for the ladder.

Figure 4:
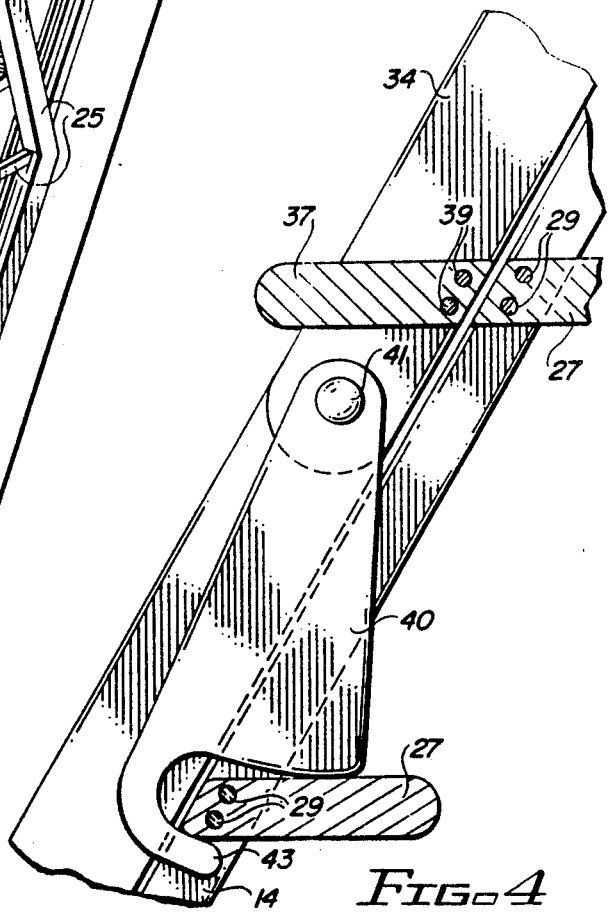
FIG. 4 is an enlargement of the portion 4 circled in FIG. 1.
Figures 2, 3:
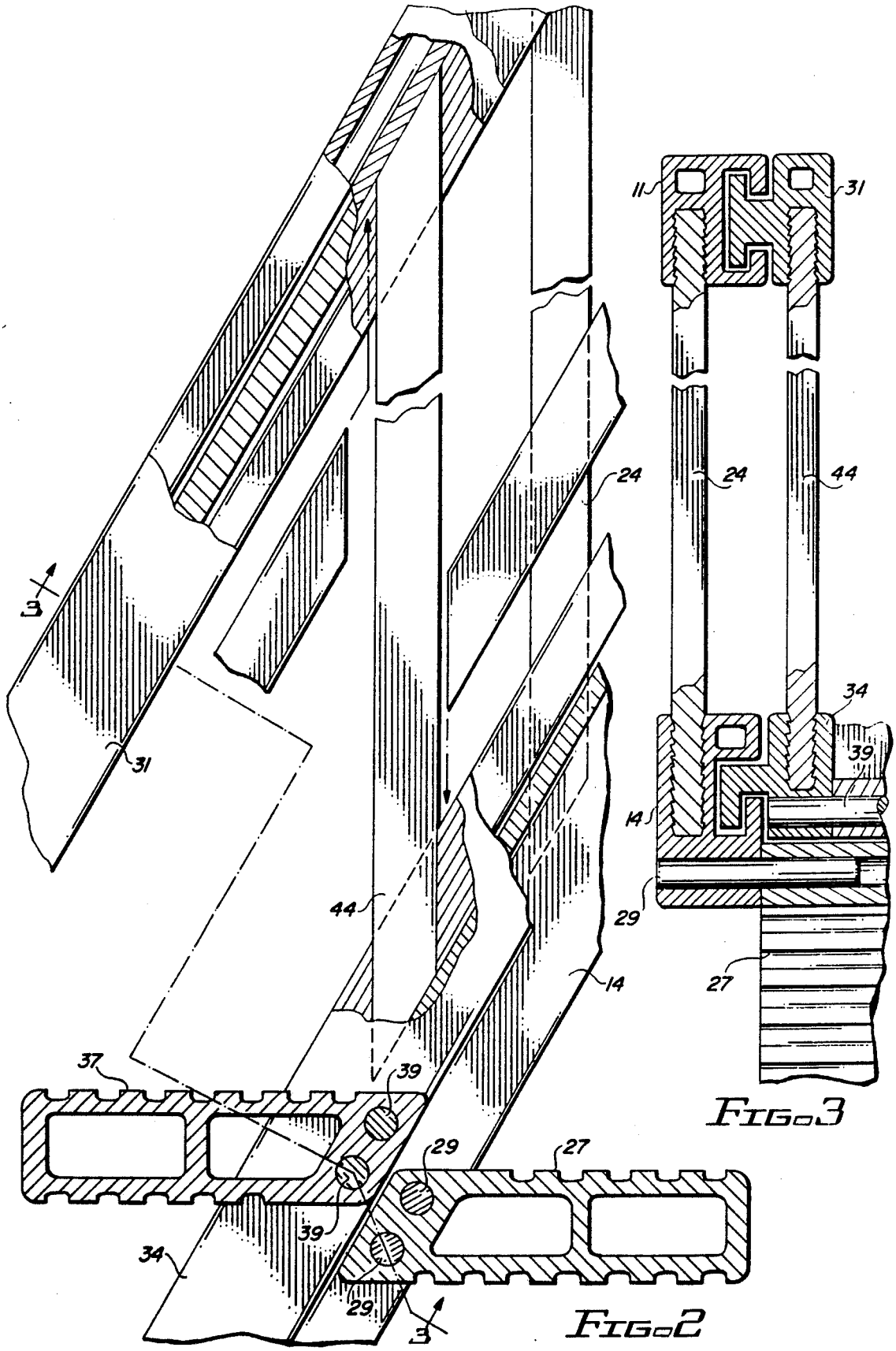
FIG. 2 is a cross-sectional view of a section of the embodiment of FIG. 1 illustrating constructional details thereof.
FIG. 3 is a cross-sectional view taken across a portion of the embodiment shown in FIG. 1 to illustrate structural details thereof.
Figure 3:
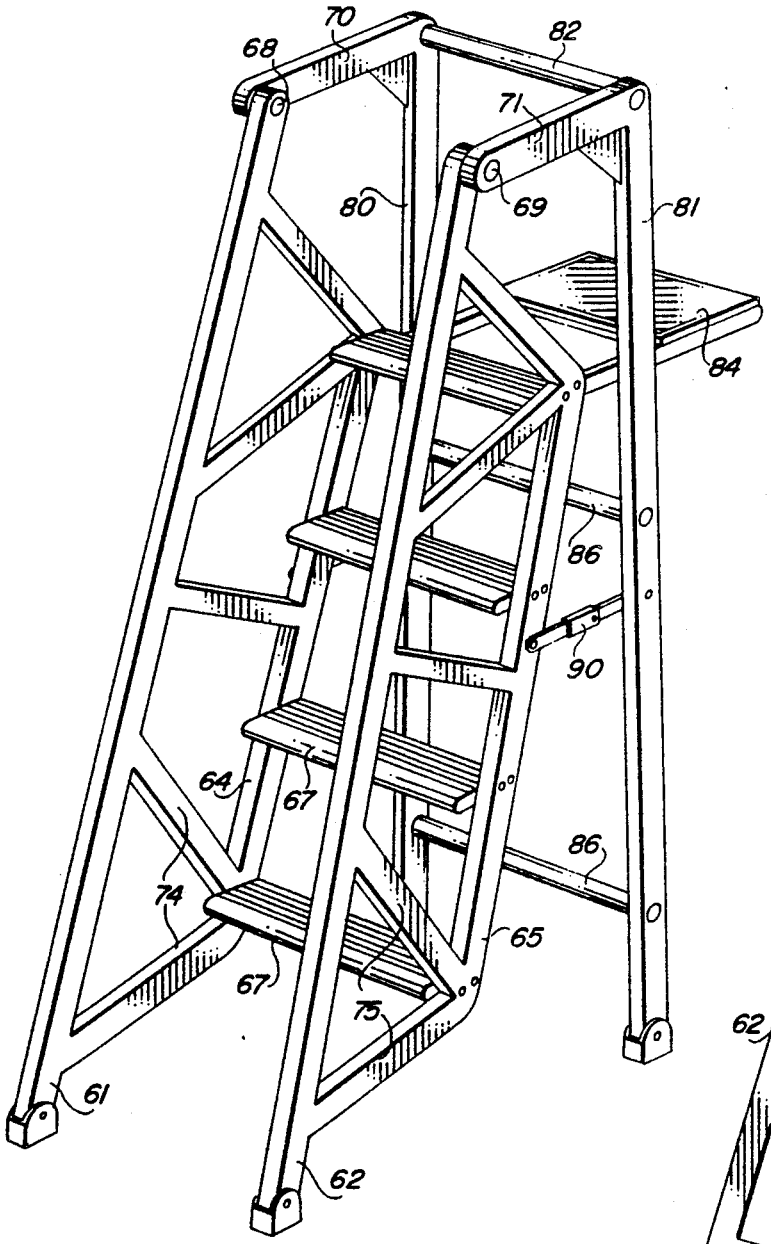

The two trusses which are formed in the manner described above, then are interconnected by uniformly spaced transverse steps or rungs 27 which extend between the rails 14 and 15, and are secured by means of pins or fasteners 29 (illustrated most clearly in FIGS. 2 and 4).

The upper section of the extension ladder shown in FIG. 1 includes a similar second set of parallel step support rails or side members 34 and 35 which are interconnected, respectively, with the main support side rails 31 and 32 by means of truss side support braces 44 and 45. As with the lower section of the ladder shown in FIG. 1, the second set of rails 34 and 35 are interconnected by a set of uniformly spaced steps or rungs 37 which are secured to the rails 34 and 35 by means of pins or suitable fasteners 39, as illustrated in FIGS. 2 and 4.

As illustrated in FIGS. 2 and 3, the upper section of the ladder is configured to slide within the space formed by the lower section of the ladder; and a pivoted dog 40, which is attached to the rail 34 on a spring-loaded pivot 41, is used to position the upper section of the ladder at the desired extension with respect to the lower section. The manner in which the dog assembly supports the upper ladder section, on one of the steps 27 of the lower ladder section, is illustrated most clearly in FIG. 4. The structure illustrated in FIG. 4 is typical of a variety of conventional structures which may be utilized to achieve this purpose, and the one shown is merely selected for the purposes of illustrating a typical way in which this support may be effected.

As is readily apparent from an examination of FIG. 2, the steps 27 on the lower section of the ladder are attached to extend outwardly toward the building wall, whereas the steps 37 in the upper section of the ladder are attached in a manner to cause them to extend inwardly into the space provided by the truss-like arrangement of the ladder. This permits the two ladder sections to slide past one another without any interference from the steps.

As illustrated most clearly in FIGS. 2 and 3, the various side rails 11, 12, 14, 15, 31, 32, 34, and 35, preferably are in the form of elongated extrusions, made of aluminum, plastic or other suitable material. The cross sections of these extrusions for a typical embodiment, are shown in FIG. 3. Other cross sections, however, may be employed. The mating cross-sectional configurations permit a sliding or telescoping arrangement of the upper ladder section comprising the side rails 31, 32, 34, and 35 alongside and within the space provided or defined by the side rails 11, 12, 14, and 15. The shapes of the various extrusions which may be made to accomplish this purpose are shown in FIGS. 2 and 3.

A number of different techniques may be used to interconnect the respective first and second sets of side rails for each of the upper and lower sections of the ladder. This can be accomplished by providing suitable extruded channels in the side rails 11, 12, 14, 15, 31, 34, and 35. Serrated enlarged ends on the respective side brace members 24, 25, 44, and 45, then force fit and tightly wedge into these channels. In addition, suitable fasteners or other techniques, such as welding, adhesives, or rivets, may be employed to securely interconnect all of the members forming the truss-like sides of each of the ladder sections to one another. The manner in which the various parts are interconnected is not significant, and conventional fabricating techniques may be utilized.

When the ladder of FIGS. 1 through 4 is used, the load-bearing rails 11, 12, 31, and 32, are placed between the ground and a vertical surface, such as a building wall, to carry the weight or the ladder and of the person using the ladder. The side rails 14 15, 34, and 35, then are suspended from the corresponding side rails 11, 12, 31, and 32, to place the load carried on the steps 27 and 37 inwardly toward the vertical wall against which the ladder is placed. This significantly improves the location of the center of gravity of the weight carried by the ladder. In addition, the side rails 11, 12, 31, and 32, function as handrails for use by the person using the ladder; so that the ladder somewhat resembles a relatively narrow "staircase" in appearance. The suspension of the weight from the outer main support side rails, however, provides significantly improved stability for the ladder when it is used.

Figure 7:
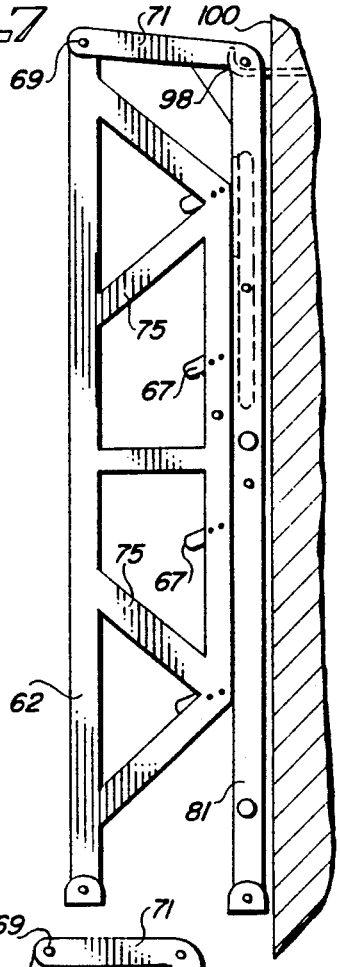
FIG. 7 illustrates the embodiment of FIG. 5 in a storage position.
Figure 6:
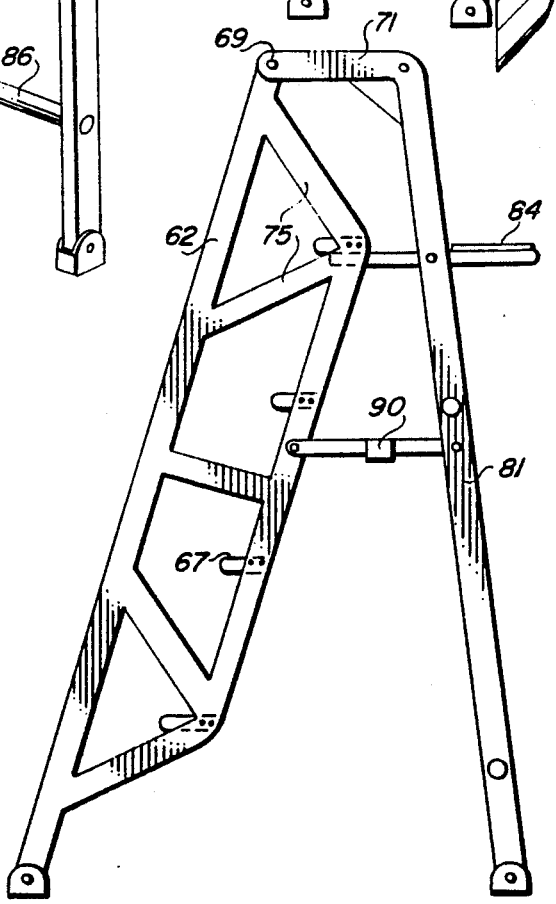
FIG. 6 is a side view of the embodiment shown in FIG. 5.

FIGS. 5, 6, and 7 illustrate the features of the invention as applied to a step ladder. Once again, a pair of outer parallel main support members or rails 61 and 62 are provided. The lower ends of these support members rest on the ground, and the upper ends are pivotally connected by means of pivot members 68 and 69, respectively, to a pair of horizontal extensions 70 and 71. The extensions 70 and 71 terminate at their opposite ends, in a pair of downwardly extending legs 80 and 81.

The legs 80 and 81 correspond to similar legs provided as the rear support surface for a standard step ladder. The step ladder of FIG. 5, however, resembles the ladder of FIG. 1 inasmuch as the weight-bearing steps 67 are connected between a pair of side rails 64 and 65 which are suspended and spaced inwardly from the side rails 61 and 62. The rails 64 and 65 are connected to the rails 61 and 62 by means of suitable truss-like support members 74 and 75, similar to the members 24 and 25 of the embodiment shown in FIG. 1.

A tool support tray 84 is pivotally interconnected between the legs 80 and 81, which also are provided with cross braces 86 for stability. The legs 80 and 81 also are interconnected to the rails 61 and 62 by folding support braces 90 of the type used in conventional step ladders. When the step ladder of FIG. 6 is in its extended position, as shown in FIGS. 5 and 6, it is readily apparent that the steps 67, which carry the weight of the person using the ladder, are suspended inwardly toward the center of the ladder from the main weight-bearing side rail portions 61 and 62. This significantly improves the stability of the ladder in the same manner described above in conjunction with the embodiment of FIGS. 1 through 4.

When the ladder of FIG. 5 is to be stored, it is folded to the position shown in FIG. 7, and may be hung on a wall 100 by means of hooks 98, as illustrated. The generally "L-shaped" side rail portions 70/80 and 71/81 of the rear support legs facilitate the collapsing of the ladder construction from its use position to its storage position in the manner illustrated.

The foregoing description of the preferred embodiments of the invention should be taken as illustrative of the invention, and not as limiting. Various changes and modifications will occur to those skilled in the art, without departing from the true scope of the invention as defined in the appended claims.

I claim:

1. A portable safety ladder including in combination;

a pair of first and second elongated, straight spaced-apart parallel main support members, each with a lower end and an upper end;

a plurality of spaced steps, each having first and second ends located in a plane parallel to the plane of said first and second spaced-apart parallel main support members, and spaced a pre-determined distance therefrom;

means for connecting the first ends of each of said steps with said first main support member, and for connecting the second ends of each of said spaced steps with said second main support member to suspend said steps from said first and second main support members; and wherein said first and second main support members serve as handrails for said safety ladder, with the lower ends thereof placed on a lower surface and the second ends thereof engaging an upper surface with said spaced steps suspended therefrom by said connecting means.

2. A portable safety ladder including in combination:

a pair of first and second elongated, straight spaced-apart parallel main support members, each having a lower end and an upper end;

a pair of first and second elongated, straight spaced-apart parallel step support members, said first and second step support members being shorter in length than said main support members;

means for connecting said first main support member with said first step support member to space said first step support member a pre-determined distance from said first main support member;

means for connecting said second main support member with said second step support member to space said second step support member from said second main support member said pre-determined distance;

a plurality of spaced steps connected across said first and second step support members; and wherein said first and second main support members serve as handrails, with the lower ends thereof placed on a lower surface and the upper ends thereof engaging an upper support, and said first and second step support members are suspended from said first and second main support members without contacting said lower surface and said upper support.

3. The combination according to claim 2 wherein said means for connecting said first main support member with said first step support member, and for connecting said second main support member with said second step support member comprise transverse brace members.

4. The combination according to claim 3 wherein said first main member and said first step support member are located in a first plane, and said second main member and said second step support member are located in a second plane parallel to said first plane.

5. The combination according to claim 2 wherein said first main member and said first step support member are located in a first plane, and said second main member and said second step support member are located in a second plane parallel to said first plane.

6. A safety ladder including in combination;

a pair of first and second spaced-apart parallel main support members, each with a lower end and an upper end;

a plurality of spaced steps, each having first and second ends located in a plane parallel to the plane of said first and second spaced-apart parallel main support members, and spaced a pre-determined distance therefrom;

means for connecting the first ends of each of said steps with said first main support member, and for connecting the second ends of each of said spaced steps with said second main support member;

wherein said first and second main support members serve as handrails for said safety ladder, with the lower ends thereof placed on a lower surface and the second ends thereof engaging an upper surface with said spaced steps suspended therefrom by said connecting means; and means for connecting the upper ends of said first and second main support members to a support frame extending downwardly to the lower surface, forming a step ladder.

7. The combination according to claim 6 wherein said support frame is hingedly connected to the upper ends of said first and second main support members to form a step ladder capable of being folded to a collapsed position for storage, and moved to an extended position for use as a step ladder.

8. A safety ladder including in combination:

a pair of first and second spaced-apart parallel main support members, each having a lower end and an upper end;

a pair of first and second spaced-apart parallel step support members;

means for connecting said first main support member with said first step support member to space said first step support member a pre-determined distance from said first main support member;

means for connecting said second main support member with said second step support member to space said second step support member from said second main support member said pre-determined distance;

a plurality of spaced steps connected across said first and second step support members;

wherein said first and second main support members serve as handrails, with the lower ends thereof placed on a lower surface and the upper ends thereof engaging an upper support, and said first and second step support members are suspended from said first and second main support members; and means for connecting the upper ends of said first and second main support members to a support frame extending downwardly to the lower surface, forming a step ladder.

9. The combination according to claim 8 wherein said support frame is hingedly connected to the upper ends of said first and second main support members to form a step ladder capable of being folded to a collapsed position for storage, and moved to an extended position for use as a step ladder.

10. A safety ladder including in combination:

a pair of first and second spaced-apart parallel main support members, each having a lower end and an upper end;

a pair of first and second spaced-apart parallel step support members;

means for connecting said first main support member with said first step support member to space said first step support member a pre-determined distance from said first main support member;

means for connecting said second main support member with said second step support member to space said second step support member from said second main support member said pre-determined distance;

a plurality of spaced steps connected across said first and second step support members;

wherein said first and second main support members serve as handrails, with the lower ends thereof placed on a lower surface and the upper ends thereof engaging an upper support, and said first and second step support members are suspended from said first and second main support members;

a second pair of first and second spaced-apart parallel main support members, each having a lower end and an upper end;

a second pair of first and second spaced-apart parallel step support members interconnected with said corresponding second pair of first and second spaced-apart parallel main support members to space said second pair of first and second spaced-apart parallel step support members a pre-determined distance from said second pair of first and second spaced-apart parallel main support members; and means for selectively interconnecting said second pairs of main support members and step support members with said first pairs of main support members and step support members to form an extension ladder.

* * * * *